United States Patent [19]

Gilb

[11] 3,946,532

[45] Mar. 30, 1976

[54] TRUSS STRUCTURE WITH FASTENER PLATE JOINT ASSEMBLY

[75] Inventor: Tyrell T. Gilb, Berkeley, Calif.

[73] Assignee: Simpson Manufacturing Company, Inc., San Leandro, Calif.

[22] Filed: Sept. 20, 1974

[21] Appl. No.: 507,943

[52] U.S. Cl. ..... 52/692; 52/693; 85/11

[51] Int. Cl.[2] ..... E04C 3/02

[58] Field of Search ..... 52/691–695, 52/639, 642, 289, 753 E, 753 L, 751, 752; 85/11, 13; 403/217, 205, 231, 232, 188, 388, 406

[56] References Cited

UNITED STATES PATENTS

| | | | |
|---|---|---|---|
| 1,762,786 | 6/1930 | McKeown | 52/642 |
| 2,169,474 | 8/1939 | Pederson | 52/642 X |
| 2,941,484 | 6/1960 | Mash | 52/642 |
| 3,336,706 | 8/1967 | Troutner | 52/693 X |
| 3,422,591 | 1/1969 | Troutner | 52/693 |
| 3,480,305 | 11/1969 | Jureit | 52/753 L |
| 3,537,221 | 11/1970 | Helfman et al. | 52/751 X |
| 3,537,224 | 11/1970 | Troutner | 52/693 |
| 3,570,204 | 3/1971 | Birkemier | 52/693 X |

*Primary Examiner*—Ernest R. Purser
*Assistant Examiner*—Carl D. Friedman
*Attorney, Agent, or Firm*—James R. Cypher

[57] ABSTRACT

A truss structure having upper and lower chords joined by metal web members in which at least one of the chords consists of parallel wood members and the joint means connecting the metal web member to the wood members includes; a pair of metal fastener plates having a drawn opening therethrough forming an annular flange fastened to the inside faces of the wood members and a metal load transfer members inserted through an opening in the metal web member, the opening in each of the plates and into counter sunk openings in the wood members. Modified forms of the invention include the addition of prong plates, and a metal sleeve between the pin and the opening in the plates.

15 Claims, 31 Drawing Figures

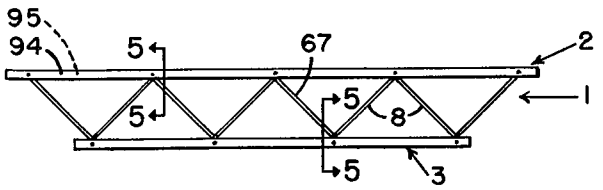
FIG. 4
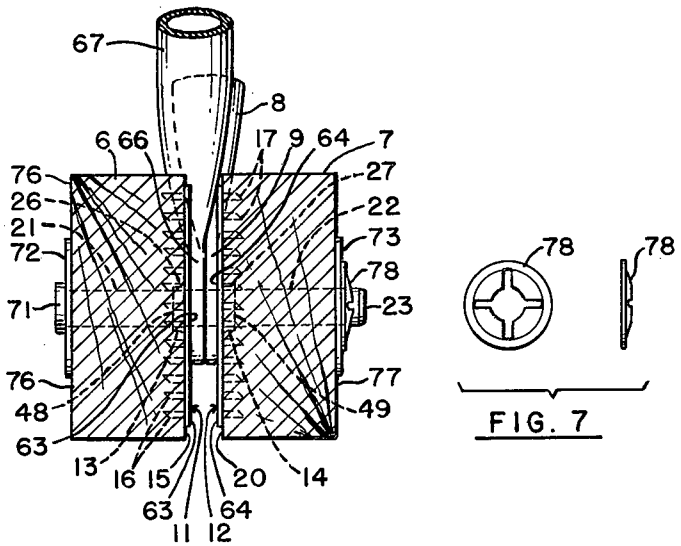
FIG. 5
FIG. 7
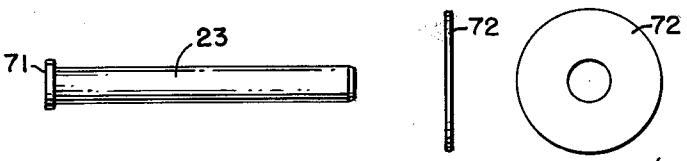
FIG. 6
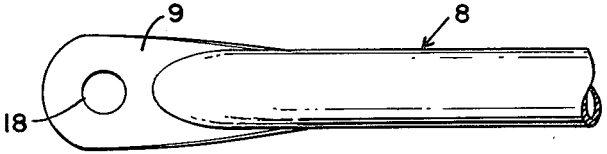
FIG. 9
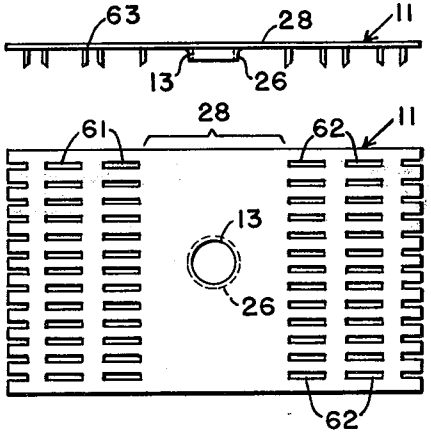
FIG. 8

TRUSS STRUCTURE WITH FASTENER PLATE JOINT ASSEMBLY

BACKGROUND OF THE INVENTION

The truss as a structural member for use in bridges and buildings has been well known for well over one hundred years. All-wood trusses and all-steel trusses have come into wide usage. The use of composite trusses which utilize wood chord members and steel web members first came into commercial usage about 15 years ago. These trusses may be found in the teachings of Troutner U.S. Pat. No. 3,422,591 and Birkemier U.S. Pat. No. 3,570,204. The steel web members are connected to the wood chords at the joints by a simple round pin which penetrates a transverse bore in the wood. Although the pin and the steel web members are obviously capable of attaining very high stresses, designers have been limited in taking advantage of these high stress valves because the wood chord has a tendency to split at the joint. While the low value joint due to wood chord splitting has been an obvious and well identified problem for the past 15 years, the truss industry has not solved the problem. Much activity, in the meantime, has occured in designing special end joint fittings, many of which are covered by patents, but the problem of chord splitting in trusses which have "bolt-through-wood" joints has remained up to the time of the present disclosure.

"Obvious" solutions of encapsulating the wood chords in steel at the joints to prevent wood splitting have proved impractical in terms of material cost, manufacturing costs, and installation costs for medium and heavy trusses.

SUMMARY OF THE INVENTION

The gist of the present invention is the use of light weight sheet metal fastener plates or prong plates to transfer the web loads to the wood chord instead of the classic metal pin.

The basic metal load transfer member and prong plate combination of the present invention gives tested allowed values for a given amount of metal which are twice the allowed International Conference of Building Officials (ICBO) values, for the prior art "bolt-through-wood" joint.

The use of the present invention "drawn opening and prong plate" combination leads to a higher design value, not merely because of the "metal to metal" bearing of the metal load transfer member to the plate, but primarily because the end-grain value in respect to the area section of the bolt bearing upon the wood is no longer the limiting factor. The wedge-split failure of the wood at the joint is no longer the first point of failure. In many designs, use of the prong plate permits use of a lower grade of wood for the chords.

The prong plate not only provides load transfer into the wood, but it also strengthens the true end-grain bearing value of the bolt to wood by resisting splitting at the joint. A distinct commercial advantage can be achieved since it is feasible to use the same size prong plate for light, medium, and heavy trusses. The same prong plate can be used for two 2 × 4's, two 2 × 6's or even two 2 × 8's.

An unexpected advantage of the prong plate is the fact that the pivot joint no longer must be at the chord center. The metal web length can be shortened and considerable savings in metal weight and web cost can be effected.

Since the prong plate distributes the joint load over a greater area of the wood chord, there is less concern for wood imperfections such as knots at the joint area than in the typical "bolt-through wood" joint.

The present invention, in addition to doubling the allowed design force values at the joint, also contributes to the performance of the structure as a whole truss system. The examples set forth below show an actual metal savings of 29 percent in three "typical" trusses as compared with the prior art trusses of "pin-through-wood" joint designs even though the present invention is *adding* a metal plate at each and every joint in the truss structure. Comparisons of metal weight are of course meaningless unless actual dollar savings is achieved. The cost savings objective has been achieved in the truss described herein as a whole, through lower material costs which outweigh the slight increase in labor costs in preparing the new joint assembly.

The comparisons detailed herein with prior art trusses were based on "equal" trusses; i.e., depth of joint, size of the top and bottom chords and panel point spacings were the same. It is expected that far more significant savings can be achieved by taking full advantage of the higher joint values achieved in the present disclosure. Other advantages of the present disclosure are: lower wood costs, further apart spacing, less restriction imposed by the $l/r$ ratio of the webs as columns due to the shorter length, and longer truss spans. It is expected that the use of trusses designed according to the present invention will result in indirect savings to the buildings as a whole which are of far greater mangnitude than those related to the truss savings themselves.

BRIEF DESCRIPTION OF THE DRAWINGS

FIG. 4 is a schematic side view of a light duty Warren truss having top and bottom wood chords joined by metal web members. The joint assembly of the present invention illustrated in FIGS. 5 – 9 may be used in both the top and bottom chords of this truss to join the double timber members of each chord to the web members.

FIG. 5 is a cross section view taken at line 5—5 of the bottom chord of the light duty truss shown in FIG. 4. The joint assembly at the top chord is the same and this fact is indicated by drawing an additional line 5—5 on the top chord of FIG. 4.

FIG. 6 is a side view of the pin illustrated in FIG. 5, and a front and side view of the end washer shown in FIG. 5.

FIG. 7 is a front and side view of a typical lock washer shown in FIG. 5.

FIG. 8 is a front and side view of one of the prong plates shown in FIG. 5. Since the prong plates in FIG. 5 are identical; both are not illustrated for purposes of brevity.

FIG. 9 is a side view of a metal web member of the type used in the truss illustrated in FIG. 4. The basic configuration of the web members is the same throughout the truss although the diameter and gauge will vary as required by design considerations.

Dashed lines A and B indicate that the top chord and bottom chord may either be constructed from two 2 × 4's, two 2 × 6's, or even two 2 × 8's. The placement of the prong plates and pin is correct as shown for all three timber sizes. This illustrates another feature of the invention in which the pin may be placed closer to the edge of the timber without causing first failure by splitting. Placement of the pin nearer the inside edge of the truss permits the use of shorter web members thereby saving considerable weight savings.

Figures 10, 11, 12, 13, 14, 15:
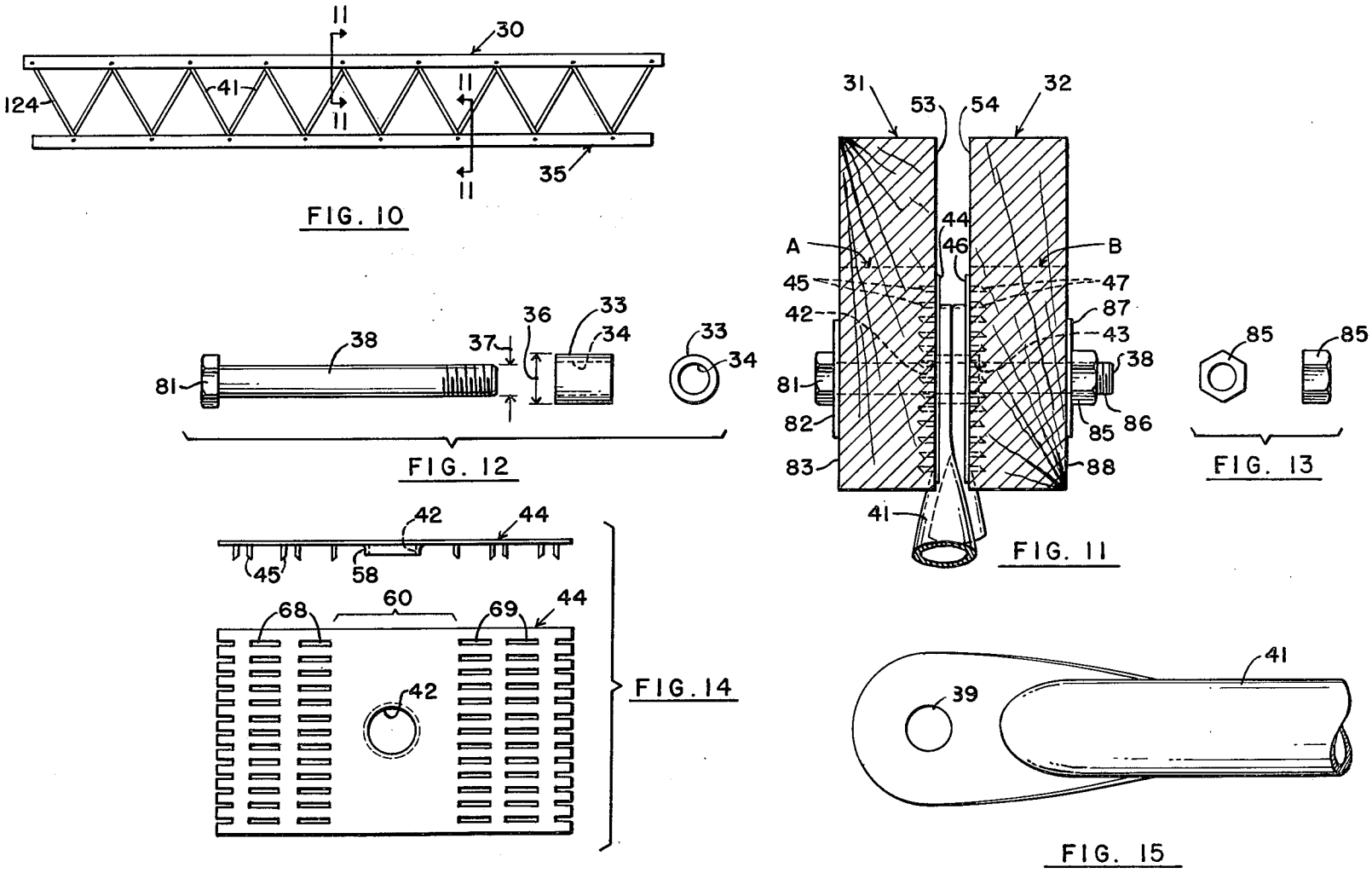
FIG. 10 is a schematic of a medium or a heavy duty Warren truss which utilizes the unique joint assembly of the present invention. The joints in both the top and bottom chords are identical except for the modification at the top chord end joints.
FIG. 11 is a cross section along line 11—11 of the top chord as shown in FIG. 10. The section line 11—11 on the bottom chord also indicates that the section shown in FIG. 11 also illustrates that the joints in the bottom chord are identical to the joints in the top chord.

FIG. 12 is a side view of the bolt shown in FIG. 11 and a side and front view of the sleeve shown in FIG. 11.

FIG. 13 is a side and front view of the bolt nut shown in FIG. 11.

FIG. 14 is a front and side view of one of the two identical prong plates shown in FIG. 11.

FIG. 15 is a side view of a portion of the type of web used in the truss illustrated in FIG. 10 and partially shown in FIG. 11. All of the webs are of the same configuration but vary in diameter and gauge as dictated by design.

Figure 16:
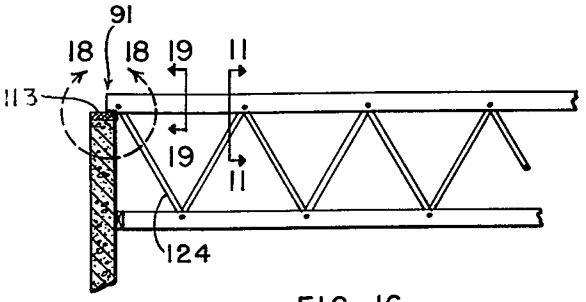

FIG. 16 is a side view of a portion of a Warren truss as previously described which is set in place on a wall. The truss may be of light duty, medium or heavy design.

Figure 17:
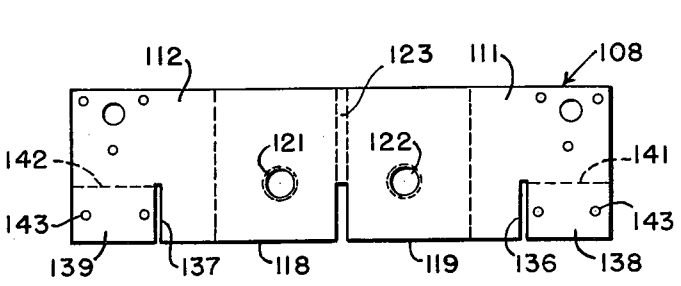

FIG. 17 is a plan view of an end connector as described in the present invention. The connector is shown as it appears cut from a flat sheet prior to bending.

Figure 18:
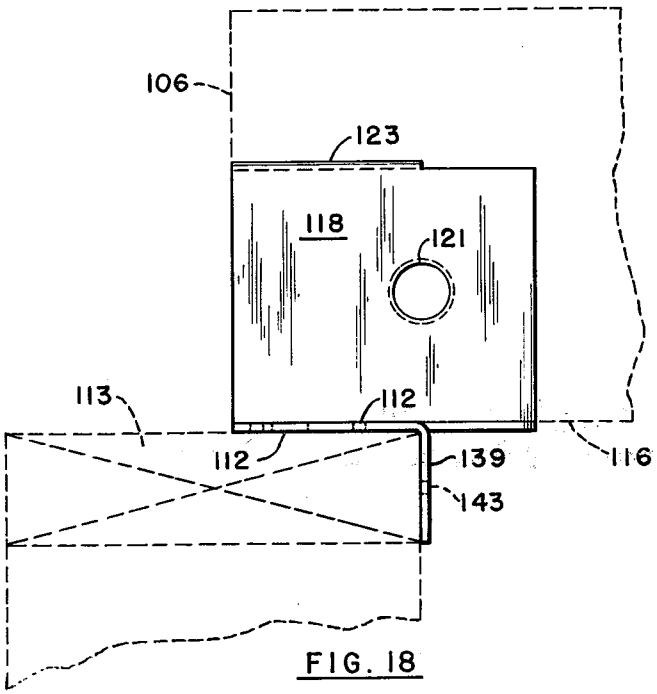

FIG. 18 is a side view of the end connector shown in FIG. 17 which has been bent and set in place on the end wall shown in FIG. 16. The dashed lines illustrate one timber in the top chord as it would appear in relation to the end connector when in place on a wall or other support. Location of the end connector is shown generally by the circular line 18—18 in FIG. 16.

Figure 19:
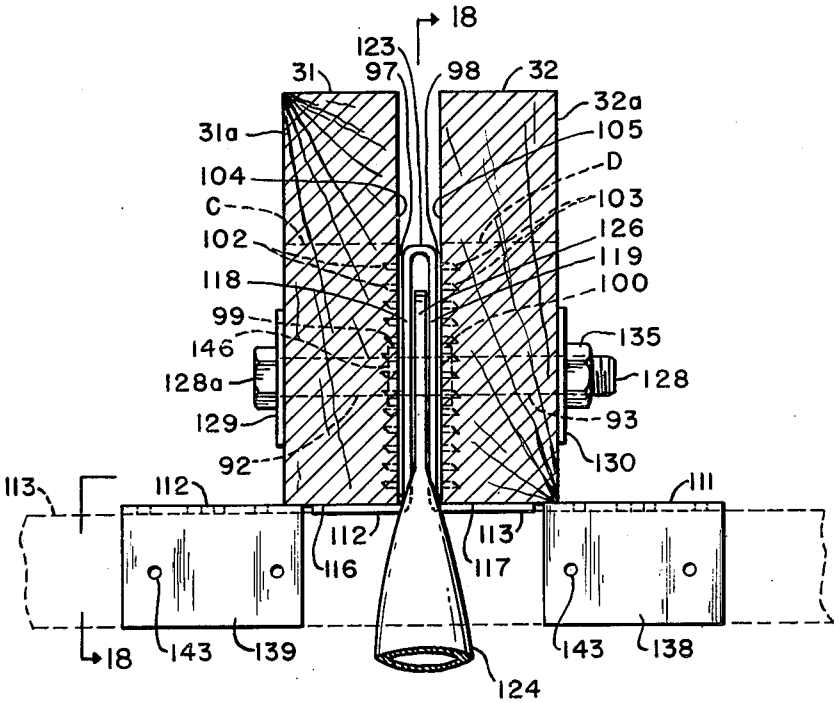

FIG. 19 is a cross section of the top chord of the truss shown in FIG. 16 taken along line 19—19 and showing end connector of FIG. 17 in relation to the pin and prong plate assembly shown in the previous FIGS. 12–15. Dashed lines B and C indicate that the end connector may be constructed with two 2 × 4's, two 2 × 6's or even two 2 × 8's.

Figure 20:
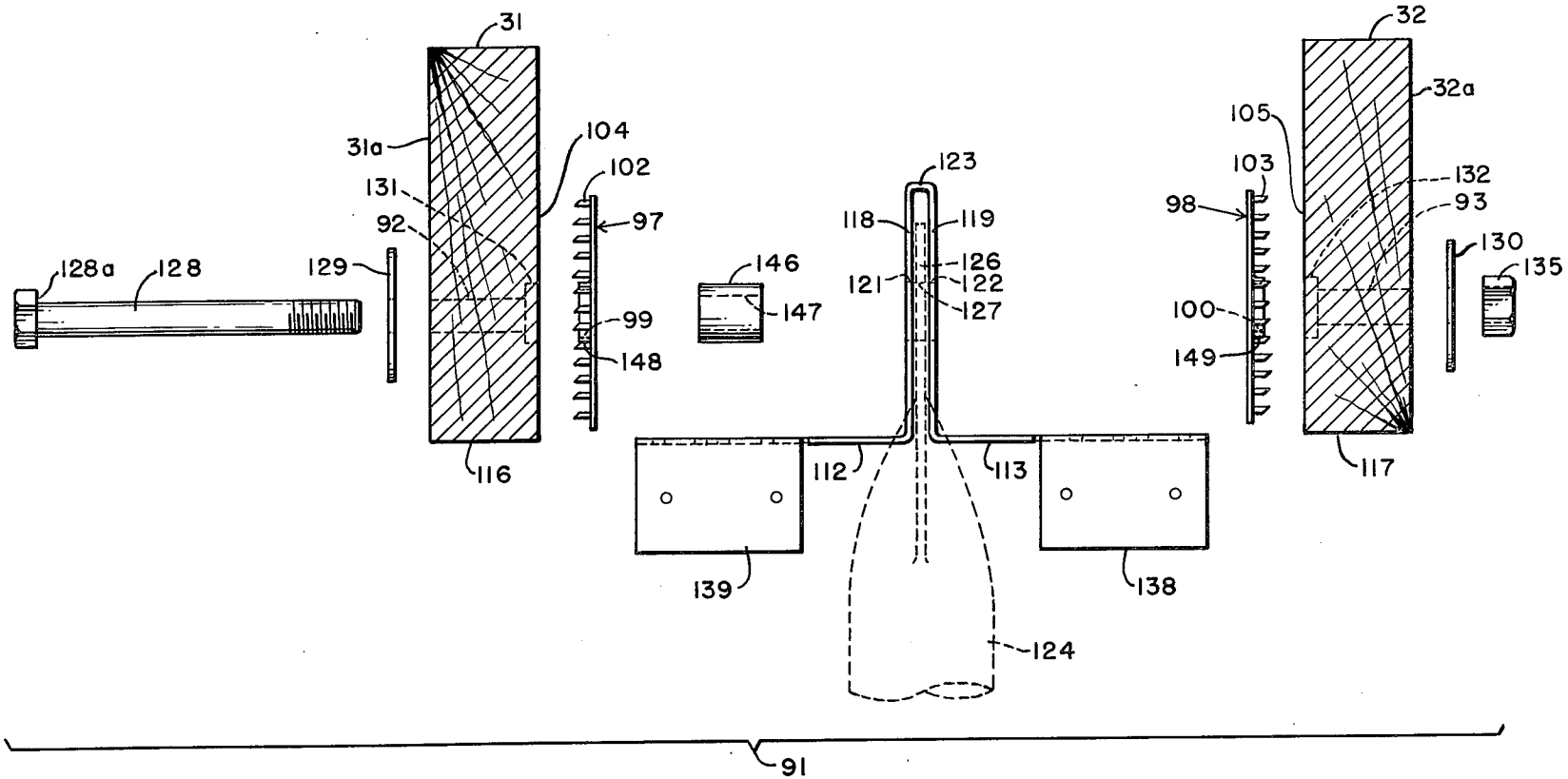

FIG. 20 is an exploded view of the end assembly and pin and prong plate joint assembly shown in FIG. 19.

Figure 21:
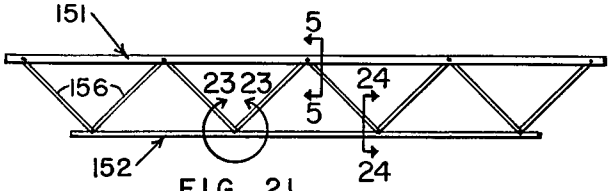

FIG. 21 is a schematic side view of a Warren truss in the light duty class in which the top chord is constructed with double timber members and utilizes the joint assemblies illustrated in FIG. 5. The bottom chord is a wood member positioned with the wide transverse dimension face up. The connectors for the bottom chord are illustrated in FIGS. 23 – 31.

Figure 1:
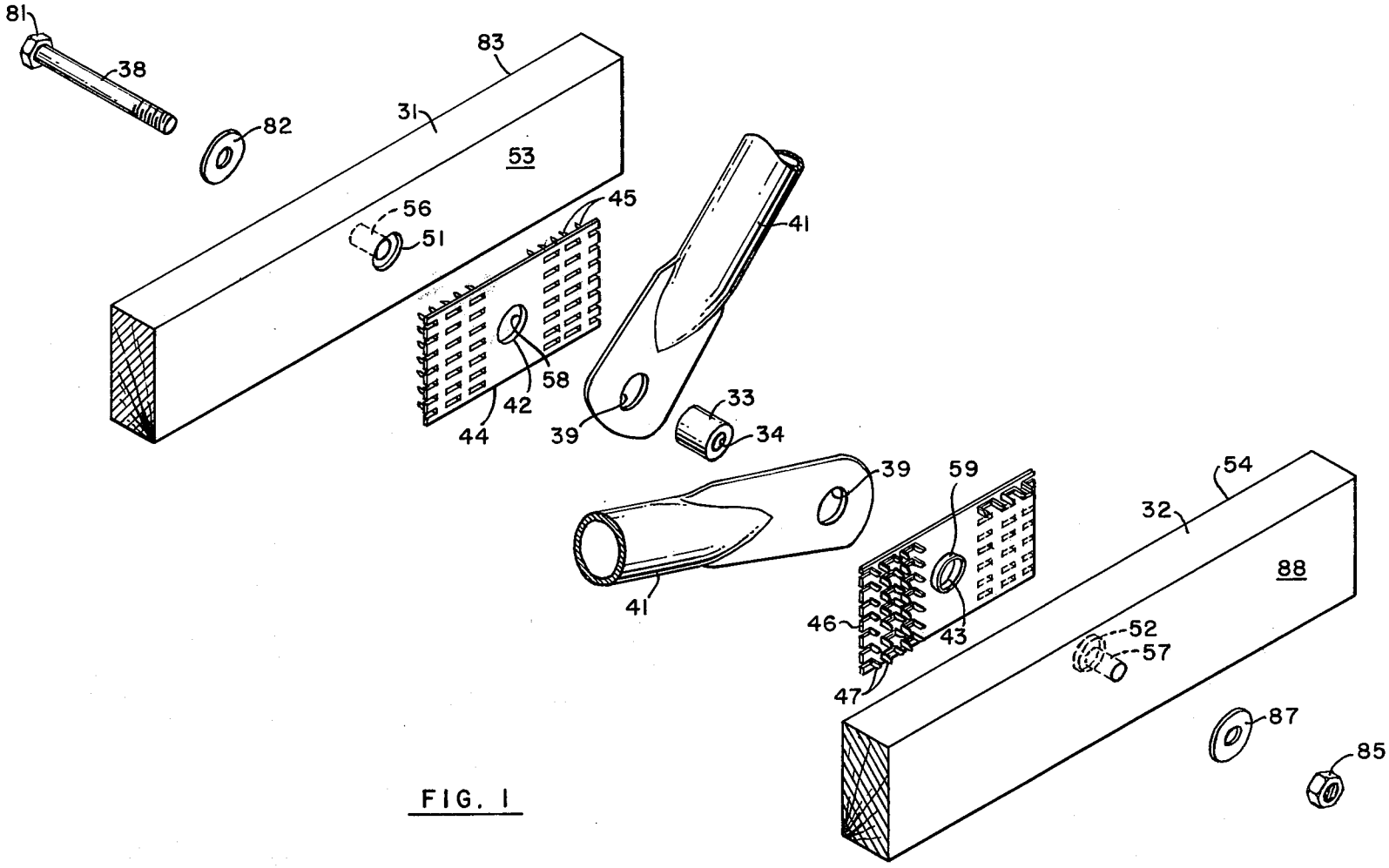
FIG. 1 is an exploded perspective view of a typical joint assembly for a medium or heavy duty truss constructed in accordance with the present invention.
Figure 22:
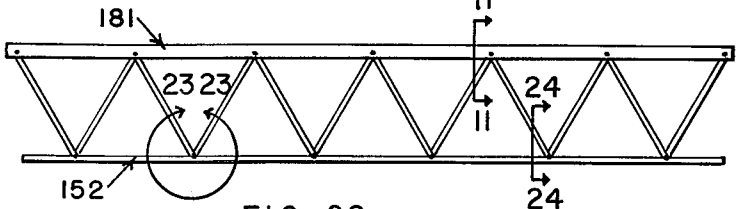

FIG. 22 is a schematic side view of a Warren truss in the medium or heavy duty class which is constructed in the same composite manner as set forth in FIG. 21; i.e., with the top chord including double timbers and using the pin and prong plate joint assemblies shown in FIG. 1 and the bottom chord consists of a single wood chord member and has edge pin connectors as shown in FIGS. 23 – 31.

Figure 23:
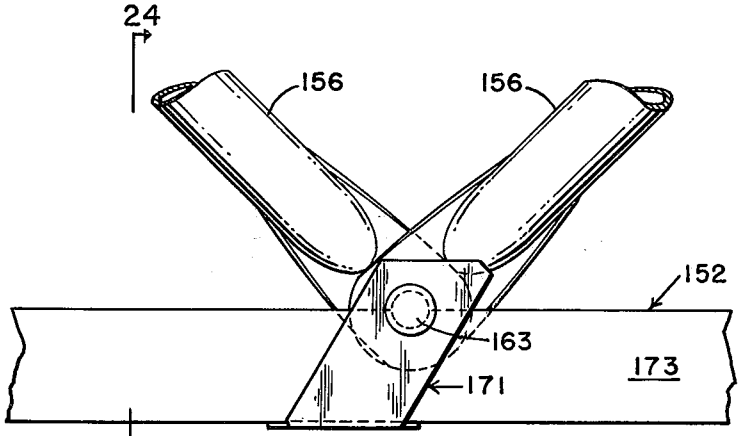

FIG. 23 is a side view of a typical edge pin connector which is used in the bottom chords of either the truss shown in FIG. 21 or the truss shown in FIG. 22. The section is taken along lines 23—23 in FIGS. 21 and 22.

Figure 24:
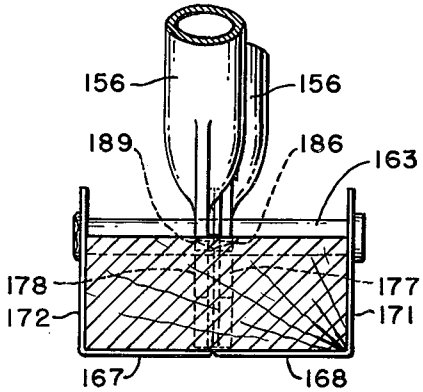

FIG. 24 is a cross section of an edge connector as used in trusses 21 and 22 taken along lines 24—24 of each figure. The view is also taken along line 24—24 of FIG. 23.

Figure 26:
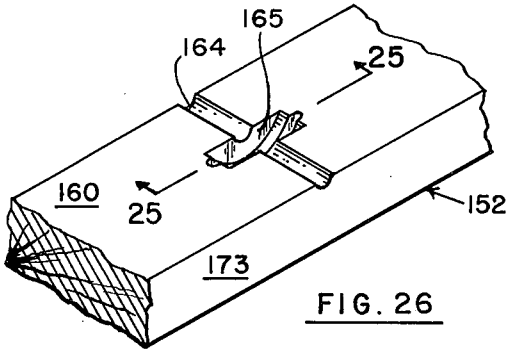
Figure 25:
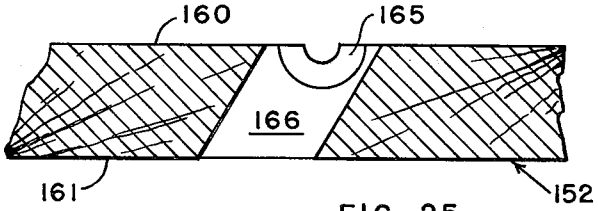

FIG. 25 is a cross section of a portion of the bottom chord of the trusses shown in FIGS. 21 and 22 and taken along line 25—25 of FIG. 26.

FIG. 26 is a perspective view of a portion of the bottom chord of the truss shown in FIG. 23 with the edge connector and webs removed for purposes of illustration.

Figure 27:
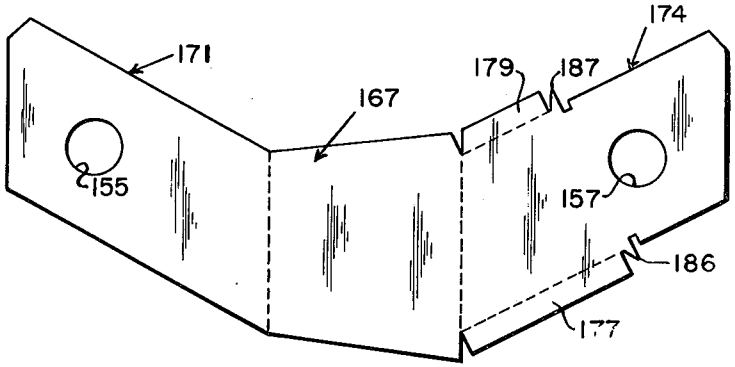

FIG. 27 is a top plan view of one part of the edge connector shown in FIG. 23. The view is of the connector as it appears after cutting from a flat sheet and prior to bending.

Figure 28:
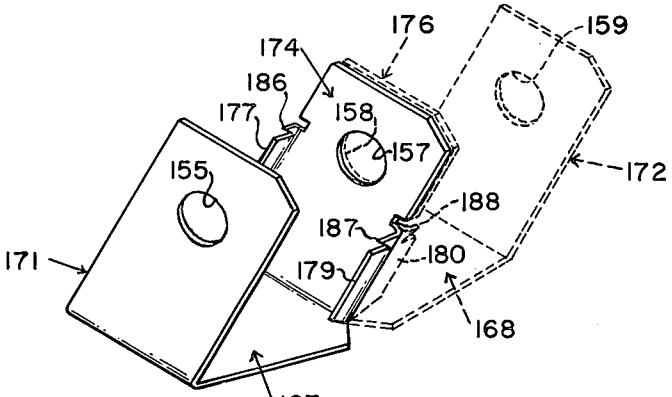

FIG. 28 is a perspective view of the edge connector shown in FIG. 23 with the pin removed.

Figure 29:
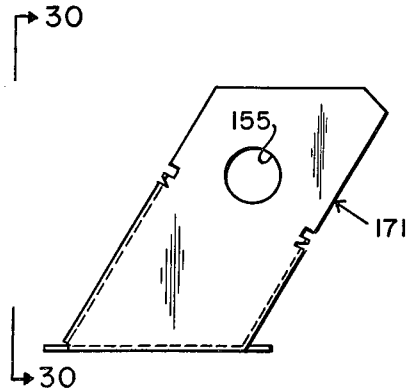

FIG. 29 is a side view of the connector shown in FIG. 27 after bending to its final shape.

Figure 30:
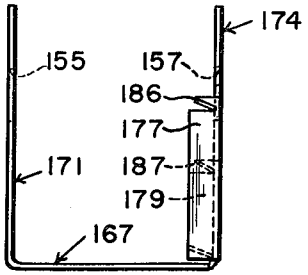

FIG. 30 is a side view of the portion of the edge connector shown in FIG. 29 and taken along line 30—30.

Figure 31:
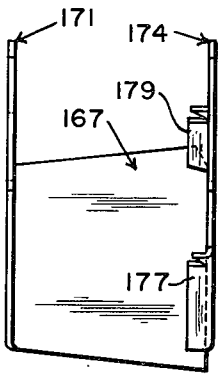

FIG. 31 is a top plan view of the portion of the edge connector shown in FIGS. 29 and 30.

BRIEF DESCRIPTION OF THE PREFERRED EMBODIMENTS

The joint assembly of the present invention is utilized in a truss structure 1 having upper and lower chords 2 and 3 wherein one of the chords consists of two juxtaposed parallel lumber members 6 and 7 and metal web members 8 having flattened end areas 9 interposed between the lumber members. The joint assembly consists briefly of a pair of sheet metal plates 11 and 12 with each plate including a pin opening therethrough; one of which is indicated by the number 13 and the opening in the other plate is indicated by the number 14. Each plate is formed with a plurality of transversely extending, sharp pointed, self-penetrating prongs extending into the inside faces 15 and 20 of the lumber members a distance substantially less than the width of one of the lumber members. The prongs of plate 11 are indicated by the number 16 and the prongs of plate 12 are indicated by the number 17. Each of the metal web members is formed with an opening 18 which registers with transverse bore openings 21 and 22 through a substantial portion of the lumber members. An elongated metal pin 23 has a diameter dimensioned to transfer forces by bearing against a substantial portion of the walls of the pin openings in the plates and the bore openings in the lumber members and the opening in the web member. The pin is positioned to span the distance between the lumber members and to penetrate the opening in the web member, the openings in the plates and a substantial distance into the lumber members.

In order to dramatically increase the joint value of the truss, the pin openings in the plates are formed with drawn sidewalls forming coaxial annular flanges 26 and 27 which provide increased bearing area in contact with the pin. Preferably, the pin openings 13 and 14 in the plates are located in the area disposed from the prongs. Thus each plate has a prong-free area 28 and 29.

MEDIUM AND HEAVY DUTY TRUSSES

FIGS. 2 and 10 – 15 illustrate a medium or heavy duty truss having a top chord 30 and a bottom chord 35.

In order to increase the metal to metal bearing area, particularly in the medium and heavy duty trusses which typically use two 2 × 4's or two 2 × 6's 31 and 32, a sleeve member 33 is provided having an opening 34 for receiving the pin or bolt therethrough. The outside diameter 36 is substantially larger than the diameter 37 of the pin or bolt 38 and the outside wall of the sleeve is positioned in registration with the opening 39 in the web 41 and the openings 42 and 43 in the plates 44 and 46. The sleeve fit with the webs in such that some rotation of the web can take place but the fit with the opening in the prong plates, may be either force fit or such as to permit some rotation of the sleeve. Primarily the purpose of the sleeve is to transmit forces from the web to the prongs 45 in the prong plates by bearing against the side wall and annular flanges of the pin openings in the prong plates.

In joint assemblies where the hole in the plate is drawn, enlarged openings 48 and 49 are provided in the inside faces of lumber members 6 and 7 and coaxially surround the transverse bores 21 and 22 and are dimensioned to receive the annular flanges 26 and 27 of the plates 11 and 12.

In the medium and heavy duty truss, enlarged openings 51 and 52 are provided in the inside faces 53 and 54 of lumber members 31 and 32 and coaxially surround the transverse bores 56 and 57 and are dimensioned to receive the annular flanges 58 and 59 of plates 44 and 46.

The combination of a sleeve bearing against the metal edges, or the drawn opening in the prong plate permits the use of smaller diameter pins than in the "pin-through-wood" chords of the prior art. Use of smaller diameter pins results in less wood cross sectional loss thereby resulting in greater chord strength at the joints. Additionally, because of the smaller pin, it is possible to locate the pin closer to the edge of the chord which can decrease the length of metal web, further contributing to lower truss weight and lower truss cost.

It should be noted that just as nails are not considered to decrease chord cross sectional area, the International Conference of Building Officials does not consider any chord loss due to the prongs of the prong plate.

As an alternate structure to the sleeve on a pin combination, the pin could be formed with an enlarged diameter portion near its mid point which would serve in the same manner as the sleeve to transmit bearing stresses but being integrally formed with the pin would prevent axial movement of the pin and a possible separation of the pin from the joint.

The pattern or shape of the prongs in the prong plates of the present invention is not critical since in all tests conducted thus far, the joint did not fail due to shifting of the prong plates in respect to the wood. Generally, the prong plate used is one in which the prongs are struck from a sheet metal plate and leave elongated slots 61 and 62 therein and the inside faces 63 and 64 of the plates 11 and 12 present a planar bearing surface to the flattened side faces 9 of web member 8 and flat face 66 of web 67. A prong plate having two areas of prongs in rows of five has proven sufficient. Each plate has a prong-free area 60.

The prong plates for heavier duty trusses are identical except for a larger opening to accommodate the sleeve. The prongs are indicated by the numbers 45 and 47 and the slots by the numbers 68 and 69.

An alternate method of attaching the sheet metal plates 11 and 12 to the wood chords instead of by integral prongs is to nail the plate to the wood using the appropriate size and number. The sheet metal plate may have pre-drilled nail openings or automatic nailing guns could be used which are capable of shooting through the metal and wood either by high pressure air or powder actuated charges.

It is necessary to hold the chord members in fixed spaced relation to one another. Preferably, the chords are held together in the joint area. This may be accomplished in several ways. The bores in the lumber members may extend transversely completely therethrough. Further, the pin extends completely through the lumber and may be formed with an enlarged head 71.

Preferably washers 72 and 73 having an enlarged surface area are held in direct bearing relation with the outer faces 76 and 77 of lumber members 6 and 7 by the enlarged head and holding member such as a lock washer 78.

Another method of holding the chord members is shown with bolt 38 holding timbers 31 and 32 together. As shown in the drawings, bolt head 81 presses washer 82 against the outer face 83 of the timber 31 and on the other timber 32 threaded nut 85 on threaded end 86 of bolt 38 presses washer 87 against outer face 88.

END BEARING ASSEMBLY

A typical end bearing support assembly 91 is shown in FIGS. 2, 16 – 20. The two parallel lumber members are formed with transverse bores 92 and 93 therethrough adjacent their ends 94 and 95. A pair of sheet metal plates 97 and 98, identical to the previously described plates and each having a pin opening 99 and 100 therethrough are provided. The means for fastening the plates to the lumber may be nails as previously described, but preferably the plates are formed with a plurality of integral transversely projecting prongs 102 and 103 which are pressed or rolled into the inside faces 104 and 105 of the lumber members adjacent their ends with the openings in registration with the bores in the lumber members.

An end bearing member 108 having spaced horizontal portions 111 and 112 adapted for resting on a support member 113 and supporting the bottom edges 116 and 117 of the lumber members and transversely spaced vertical portions 118 and 119 formed with openings 121 and 122 in registration with the plate openings and joined at their upper ends 123 is positioned between the lumber members. Pin means such as a pin or bolt 128 penetrates the bores in the lumber members, the pin openings in the plates, the openings in the end member and the opening 127 in the flat end 126, web 124 and transfers the forces in the wood timbers and the web to the end bearing member. The timber members are preferably connected by the threaded bolt with the bolt head 128a pressed against washer 129 engaging face 31a of timber 31 and nut 135 pressing washer 130 against face 32a of the timber 32.

The end bearing member is preferably formed with means to engage the support member. As shown in the drawings, the horizontal portions of the end bearing member are formed with end slots 136 and 137 parallel to the axis of the truss forming bend tabs 138 and 139 for bending along lines 141 and 142. The tabs may be formed with nail openings 143.

The force value of the end bearing assembly located adjacent end 106 and 107 of chord members 31 and 32 is dramatically increased by providing a sleeve 146 having an opening 147 therethrough which is dimensioned for close fitting coaxial relation with the pin. The sleeve has a diameter substantially greater than the diameter of the pin. The sleeve is positioned for engagement with the sides of the opening in the web, the annular flanges 148 and 149 in the plates and the openings in the vertical portions of the end bearing member. The sleeve has a length projecting into bores in the timber members substantially less than the width of the members and the ends of the sleeves bearing against the shallow openings 131 and 132 in the wood chords serve to maintain the selected spacing between the chords.

MATERIAL SPECIFICATIONS

Light Duty Trusses

In the light duty trusses, normally the timber members are two 2 × 4's and the pins are ½ in. diameter with an overall length of 4 in. The pin is held by washers 1⅞ in. diameter, 12 gauge with a 9/16 inch opening. A standard 1⅛ in. lock washer holds the washer against the chord.

The prong plate may vary in size, but it is commercially more practical to provide a plate of 18 gauge about 3.5 in. × 5 in. to 5.5 in. The teeth have a minumum length of 5/16 in. and there should be a minumum of 56 prongs in each prong area which varies from 3.2 in. × 1.23 in. to a miximum of 3.5 in. × 1.5 in. An area of prongs should surround the opening and an area of 2½ in. × 3.2 in. to 3.5 in. is preferable. While the tooth pattern and shape of tooth is not apparently critical, the drawings show teeth which are diagonally cut or scarfed and are disposed in transversely aligned rows so that the slots leave solid strands of transversely and axially extending metal. An 18 gauge prong plate of the size describes weighs slightly under ¼ lb.

The web member for the light truss may be 1 in. in diameter with a ½ in. diameter hole. The steel tubes for the webs are fabricated from flat rolled electrically welded carbon sheets of structural quality, of gauges providing various wall thicknesses, conforming to U.B.C. Standard No. 27-l for light gauge steel having a minimum yield point of 46,000 pounds per square inch. The web pipe ends are flattened to over 1½ in. width, with tapered swedged ends of the tubing section terminating ¾ in. from a center point in the flattened area. A ½ inch diameter hole is punched at this centerpoint. The flattened material extends beyond this centerpoint so that not less than a radius of ¾ inch of material edge distance is provided in any direction from this centerpoint.

Medium duty trusses

A typical medium duty truss could use either two 2 × 4's or two 2 × 6's. The through-bolt or pin has a ½ inch diameter and a length of 4 inches to 5 inches. The prong plates may be 18 gauge with a pin opening of ¾ inch. The prong dimensions and density are the same as in the light duty truss. The sleeve is ¾ inch outside diameter and has an inside diameter opening of ½ inch with a length of ⅞ inch. The web is 1½ inch diameter and has an opening of ¾ inch. The flattened material extends beyond the center point of the opening not less than a radius of 1⅛ inch.

Heavy duty truss

The typical heavy duty truss also may use either two 2 × 4's or two 2 × 6's. The web diameter is 2 inches with a ½ inch, ¾ inch or 1 inch diameter opening. With a 1 inch opening, the flattened material should extend beyond the center of the opening not less than 1½ inch. The threaded bolt is ½ inch diameter with a length of 4 to 5 inches.

The sleeve is a typical 1 inch outside diameter with a ½ inch inside opening and a length of ⅞ inch. The prong plate is the same as previously described. In some instances a 16 gauge plate will be preferable. In each instance, the pin opening in the prong plates is drawn a minimum 0.110 inches.

End bearing assembly

The end bearing assembly is preferably made from a rectangular flat sheet of about ¼ inch material. It is fabricated so that all potential bends are in one direction. It is multipurpose in that it is used for most lower chord bearing conditions. One feature is that it inherently provides against uplift. Another feature is that it provides the ½ inch desired spacing and can be used for any series of trusses.

Assembly of the truss

Assembly of the truss is as follows: First, the ½ inch transverse bores are drilled in the lumber chord members and where specified, the approximately 3/16 inch drill-routed shallow hole for the ¾ inch to 1 inch drawn area is made. The prong plates are then positioned by the drawn rings into the drill-routed holes and roll-pressed or ram-pressed into the wood. The bolt, or pin is inserted in one side of a chord element, inside-face up with the necessary washer on the outside. Where specified, the sleeve is placed over the bolt or pin and then the webs are placed over the sleeve or bolt. The other lumber member which has been previously prepared with the bore, shallow opening and prong plate is then placed onto the assembly. Finally, the nut, or retainer system and the final washer are placed on the bolt or pin.

Prong plate placement

In the "pin-through-wood" type trusses, of the prior art, the tendency of the pin to split the wood at the joint is the first area to fail in the truss. The use of the prong plates, however, of the present disclosure decreases the tendency of the chords to split to such a degree that it is not necessary to locate the pin at the center of the chord. In 2 × 6 wood chords this means that the pin can be moved inwardly thereby shortening the metal web by about 2¼ inch. This factor decreases metal weight and metal cost.

COMPARISON EXAMPLES

Example No. 1

In the first example, the truss length was fixed at 40 feet, truss depth of 24 inches and a floor loading of 80 pounds per square foot.

| | |
|---|---|
| Pin through wood truss | |
| A. Total weight of web members | 63.11 lbs. |
| B. Total weight of pins and retainers | 24.41 lbs. |
| | 87.52 lbs. |
| Pin plate truss of present invention | |
| A. Total weight of web members | 53.61 lbs. |
| B. Total weight of pins, sleeves, prong plates and retainers | 17.7 lbs. |
| | 71.31 lbs. |

In conclusion, the prior art pin-wood truss in Example 1 requires 22.7 percent more metal by weight than the pin prong truss of the present invention.

Example No. 2

In the second example, the truss length was 48 feet, depth 48 inches and a floor load of 60 pounds per square foot (or roof 8 foot C 30 pounds per square foot).

| | |
|---|---|
| Pin through wood truss | |
| A. Total weight of web members | 117.48 lbs. |
| B. Total weight of pins and retainers | 38.29 lbs. |
| | 155.77 lbs. |
| Pin plate truss of present invention | |
| A. Total weight of web members | 90.13 lbs. |
| B. Total weight of pins, sleeves, prong plates and retainers | 22.76 lbs. |
| | 112.89 lbs. |

In conclusion, in the second example, the pin-wood truss required 37.89 percent more metal by weight than the pin prong plate of the present invention.

Example No. 3

In the third example, the truss length was 62 feet, depth of truss 5 feet, the trusses were for a roof in which the trusses were spaced 4 feet apart, center to center. Loading was 36 pounds per square foot.

| | |
|---|---|
| Pin through wood truss | |
| A. Total weight of web members | 126.01 lbs. |
| B. Total weight of pins and retainers | 32.59 lbs. |
| | 158.6 lbs. |
| Pin plate truss of present invention | |
| A. Total weight of web members | 103.36 lbs. |
| B. Total weight, pins, sleeves, prong plates and retainers | 22.33 lbs. |
| | 125.69 lbs. |

In conclusion, the pin through wood truss required 26.2 percent more metal by weight than the pin prong plate truss of the present invention.

Another form of my invention is shown in FIGS. 3 and 21–31. In this form of the invention, the upper chord utilizes two lumber members and the joint assembly previously described. The bottom chord member, however, may be a single lumber member and uses a connector assembly as described in my co-pending application Ser. No. 380,215. Since the description of the different types of joint assemblies for the top chord is identical to those previously described, the drawing and detailed description is not repeated for purposes of brevity.

Composite truss (light duty)

In the description that follows, please refer to FIGS. 5 – 9 where reference is to the top chord, and FIGS. 23 – 31 where reference is to the bottom chord. The web members are identical in shape and detail for the preferred and the alternate type of truss.

Figure 3:
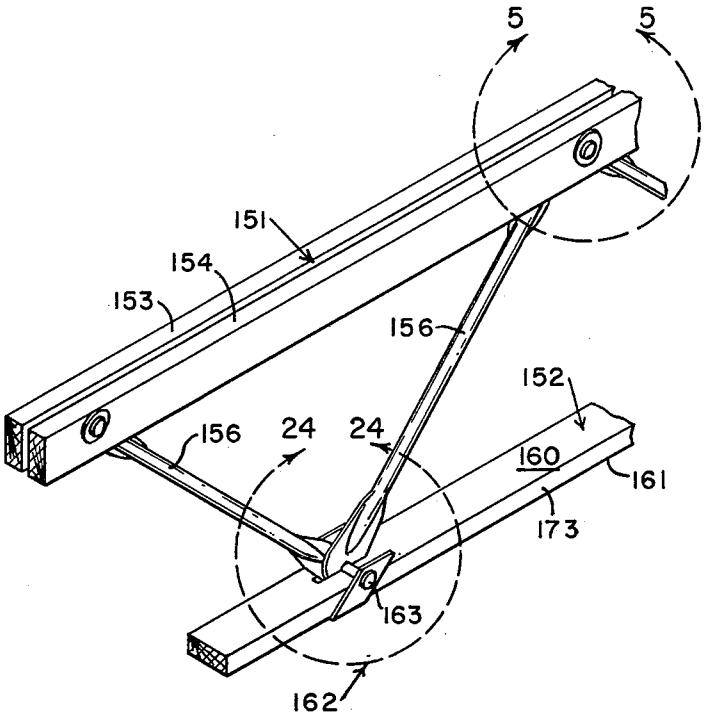
FIG. 3 is a perspective view of a portion of an alternate form of truss referred to herein as a composite truss. All of the joint assemblies in the top chord are constructed in accordance with the joint assembly illustrated in FIG. 5 in light duty trusses and in accordance with the joint assembly illustrated in FIGS. 1 and 11 in medium and heavy duty trusses. The bottom chord is connected to the web members using an edge pin connector illustrated in FIGS. 23–31.
Figure 2:
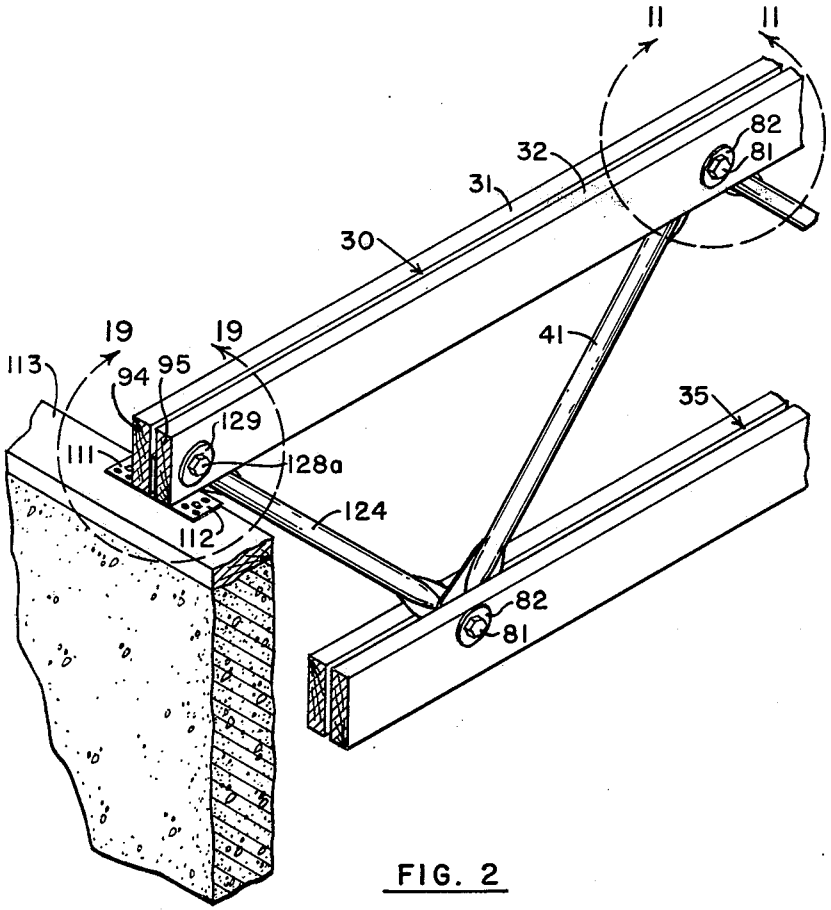
FIG. 2 is a perspective view of a portion of a medium truss resting upon a wall or other support. the construction of the joint assemblies in both the top and bottom chords is identical to the joint assembly shown in FIG. 1. The end joint assembly is constructed with an additional end bearing member illustrated in FIGS. 19 and 20.

Briefly, the alternate type of truss structure of the present invention consists of upper chord members 151 as shown in FIGS. 3, 5, and 21, and lower chord member 152 as shown in FIGS. 3, 23, and 21.

The upper chord includes two juxtaposed parallel lumber members 153 and 154 which correspond to lumber members 6 and 7 formed with transversely bored pin openings 21 and 22 at spaced intervals; a plurality of metal web members 156 having flat ends formed with openings at both their ends; a plurality of top chord sheet metal plates 11 and 12 each having a pin opening 13 and 14 therethrough; means fastening the sheet metal plates to the inside faces 15 and 20 of the top chord lumber members with the openings in the sheet metal plates in registration with the bores in the parallel top chord lumber members; a plurality of elongated metal top chord pins 23 registering with the openings in the web members, the openings in the plates, and the bores in the top chord lumber members for tansferring the forces from the web members to the upper chord member; a lower wood chord 152 having flat inner and outer faces 160 and 161 and the chord has a width greater than its depth; a plurality of sheet metal connectors 162 mounted on the lower chord; a plurality of bottom chord pins 163 mounted transversely of the bottom chord pivotally securing the ends of the web members at the midpoint of the pins to openings 155, 157, 158, and 159 in the connectors wherein the pivot points are located at the inner faces of the bottom chord; the bottom chord is formed with transverse semi-circular grooves 164 having a depth approximately one-half the diameter of the bottom chord pin for receiving the partially embedded pins; the bottom chord is formed with slots 166 joining the inner and outer faces at the approximate center lines of the bottom chord and a widened slot area 165 for accommodating the web ends; each of the connectors including a pair of seats 167 and 168 engaging the outside faces of the bottom chord, each connector having a pair of legs 171 and 172 disposed in close fitting relation to the outside edges 173 of the bottom chord and connecting the seats and opposite ends of the pin and each of said connectors having an arm 174 and 176 mounted in the slot connecting the seats and the mid portion of the pin; the seats and legs of the connector and pin completely encapsulating the bottom chord at its inner and outer faces and edges; the connector arms are formed with edge flanges 177 and 178 (not shown) extending a substantial portion therealong and extending transversely of the bottom chord for close fitting engagement therewith for transmitting forces from the web members to the mid portions of the bottom chord; and said bottom chord is formed with channels extending from its outer face toward its inner face at the approximate center line of the bottom chord for force fit receipt of the flanges of the connector. The connector arms may also be formed with edge flanges 179 and 180.

Composite truss (medium and heavy duty)

The medium and heavy duty trusses include the following elements in addition to those above set forth and are shown in FIGS. 22 and 10 – 15; the means connecting the plates to the top chord 181 lumber members 31 and 32 consists of a plurality of transversely projecting prongs 45 and 47 integrally formed in the plate members 44 and 46; each of the pin openings 42 and 43 in the plates is formed with a drawn sidewall forming coaxial annular flanges 50 and 55 providing increased bearing area in contact with the pin 38, and the pin opening is positioned in an area 60 of the plate disposed from the prongs; a plurality of sleeve members 33 having an opening 34 therethrough for receiving the top chord pins 38 and having an outside diameter 36 substantially larger than the diameter 37 of the pin; the outside wall of each of the sleeves is positioned in registration with the openings 39 in the upper ends of said web members and the pin openings in the plates.

In the connector of the bottom chord, cutting teeth 186, 187, 188, and 189 are formed in leading relationship to each of the flanges 177, 178, 179 and 180 on the arms for forming a channel in the bottom chord upon being driven into the bottom chord for force fitting occupancy by the flange; and the arms and the legs of the bottom chord connector are angularly related to the plane of the seat offsetting the bottom chord pin from the center line of the seat.

I claim:

1. A truss joint assembly for transferring tension and compression loads between wood members and metal members in a truss structure having upper and lower chords wherein one of said chords consists of two juxtaposed parallel lumber members, and metal web members having flattened end areas interposed between said lumber members comprising:

a. a pair of continuous sheet metal fastener plates, each including an opening therethrough, and a fastener area on both sides of said opening and disposed from said opening leaving an area around said opening free of fasteners;

b. a plurality of sharp pointed fastener means sufficient in number to transfer substantially all of the web load to said lumber member having a length less than the width of said lumber member connecting said fastener area of said plates to said chord by penetrating the inside faces of said lumber members at a plurality of closely spaced intervals in order to reduce the possibility of failure of said lumber by splitting;

c. the flattened ends of said metal web members are formed with openings therethrough;

d. each of said openings in said plates is surrounded by integrally formed drawn sidewalls extending into said lumber members forming a coaxial annular flange providing bearing area;

e. there being enlarged counter sunk openings in the inside faces of said lumber members dimensioned to receive said annular flanges of said plates in a force fit;

f. a metal load transfer member having a diameter and a length dimensioned to transfer loads between said metal fastener plates and said metal web members by bearing against a substantial portion of said metal plate flanges in a force fit, and against the edges of said openings in said metal web members;

g. means providing lateral support for holding the members of said assembly together; and h. said web members, plates, fastener means and load transfer member are positioned so that substantially all load transference from said web members to said wood chord members occurs immediately adjacent the centerline of said truss through said plurality of sharp pointed fasteners.

2. In a truss structure as described in claim 1 comprising:

a. said fastener means includes a plurality of transversely extending, sharp pointed, self-penetrating prongs integrally formed in each of said plates extending into the inside faces of said lumber members a distance substantially less than the width of one of said lumber members.

3. In a truss structure described in claim 2 comprising:

a. said prongs being struck from said sheet metal plates and leaving elongated slots therein; and b. the inside faces of said plates presenting a planar bearing surface to said flattened side faces of said web members.

4. A joint assembly as described in claim 1 comprising:

a. said lumber members are formed with bores extending transversely therethrough;

b. said load transfer member is a cylindrical member having a length extending laterally through said bores in said chords, the openings in said plates, and the opening in said webs; and c. means releasably connected to the ends of said load transfer member for holding said load transfer member in relation to said webs and chords.

5. In a truss structure described in claim 4 comprising:

a. said load transfer member is formed with a centrally located substantially enlarged diameter area; and b. said enlarged area having a length for bearing registration with the opening in said web, and the openings in said plates.

6. In a truss structure as described in claim 4 comprising:

a. a sleeve member having an opening therethrough for receiving said load transfer member and having an outside diameter substantially larger than the diameter of said load transfer member, and having a length substantially less than the length of said load transfer member; and b. the outside wall of said sleeve being positioned in registration with the opening in said web and the openings in said plates thereby transmitting forces from said web to said wood chords through the bearing surfaces surrounding said plate openings.

7. In a truss structure as described in claim 4 comprising:

a. said load transfer member comprises a threaded bolt having an enlarged head at one end and a threaded portion at the other end, a pair of washers and a threaded nut.

8. In a truss structure having upper and lower chords joined by web members and joint assembly members as described in claim 1 comprising:

a. an end bearing member having spaced horizontal portions adapted for resting on a support member and supporting the bottom edges of said lumber members, and transversely spaced vertical portions formed with openings in registration with said plate openings and joined at their upper ends;

b. one of said web members is formed with a flattened end and an opening therethrough for registration with and positioning between the openings in said vertical portions of said end bearing member; and c. pin means penetrating the bores in said lumber members, the pin openings in said plates, the openings in said end member and the opening in said web.

9. In a truss structure as described in claim 8 comprising:

a. said horizontal portions of said end bearing members are formed with end slots parallel to the axis of said truss forming bend tabs bent along a line and adapted for connection to said support member.

10. In a truss structure as described in claim 8 comprising:

a. a sleeve member having an opening therethrough dimensioned for close fitting coaxial relation with said pin and having a diameter substantially greater than the diameter of said pin;

b. said sleeve is positioned for engagement with the sides of the opening in said web, the annular flanges in said plates, and the openings in the vertical portions of the end bearing member; and c. said sleeve has a length projecting into said timber members substantially less than the width of said members.

11. A truss structure comprising:

a. upper and lower wood chord members;

b. said upper chord includes two juxtaposed parallel lumber members formed with transversely counter sunk openings at spaced intervals;

c. a plurality of metal web members having a flat end with an opening therethrough;

d. means connecting the ends of said web members with said lower chord member;

e. a plurality of sheet metal fastener plates, each having fastener areas at either end and, a drawn opening forming a flange therethrough in the center area which is free of fasteners;

f. said fastener areas of said plates including a plurality of sharp pointed fasteners for fastening said sheet metal plates to the inside faces of said lumber members with said flanges of said drawn openings in said sheet metal plates in registration with said counter sunk openings in said parallel lumber members; and g. a plurality of elongated metal load transfer members registering with the openings in said web members, the flanges of said drawn openings in said plates, and the counter sunk openings in said lumber members for transferring the forces from said web members to said upper chord member.

12. A truss structure as described in claim 11 comprising:

a. said fasteners connecting said plates to said lumber members consist of a plurality of transversely projecting prongs integrally formed in said plate members.

13. A truss structure as described in claim 11 comprising:

a. a plurality of sleeve members having an opening therethrough for receiving said load receiving member and having an outside diameter substantially larger than the diameter of said load receiving member;

b. the outside wall of each of said sleeves is positioned in registration with the openings in said web members and the flanges of said openings in said plates;

c. said upper chords are formed with transverse bores therethrough; and d. said load transfer members have a length extending into said counter sunk openings in said chords, said metal plates and said web members.

14. A truss structure comprising:

a. upper and lower chord members;

b. said upper chord includes two juxtaposed parallel lumber members formed with transversely bored pin openings at spaced intervals;

c. a plurality of metal web members having flat ends formed with openings at both their ends;

d. a plurality of top chord sheet metal plates, each having a pin opening therethrough;

e. means fastening said sheet metal plates to the inside faces of said top chord lumber members with said openings in said sheet metal plates in registration with said bores in said parallel top chord lumber members;

f. a plurality of elongated metal top chord pins registering with the openings in said web members, the openings in said plates, and the bores in said top chord lumber members for transferring the forces from said web members to said upper chord member;

g. a lower wood chord, having flat inner and outer faces and said chord having a width greater than its depth;

h. a plurality of sheet metal connectors mounted on said lower chord;

i. a plurality of bottom chord pins mounted transversely of said bottom chord pivotally securing the ends of said web members at the midpoint of said pins to said connectors wherein the pivot points are located at said inner faces of said bottom chord;

j. said bottom chord being formed with transverse semicircular grooves having a depth approximately one-half the diameter of said bottom chord pin for receiving said partially embedded pins;

k. said bottom chord being formed with slots joining said inner and outer faces at the approximate center lines of said bottom chord;

l. each of said connectors including a pair of seats engaging the outisde faces of said bottom chord, each connector having a pair of legs disposed in close fitting relation to the outside edges of said bottom chord and connecting said seats and opposite ends of said pin and each of said connectors having an arm mounted in said slot connecting said seats and the mid portion of said pin;

m. said seats and legs of said connector and pin completely encapsulating said bottom chord at its inner and outer faces and edges;

n. said connector arm being formed with an edge flange extending a substantial portion therealong and extending transversely of said bottom chord for close fitting engagement therewith for transmitting forces from said strut members to the mid portions of said bottom chord; and o. said bottom chord being formed with channels extending from its outer face toward its inner face at the approximate center line of said bottom chord for force fit receipt of said flange of said connector.

15. A truss structure as described in claim 14 comprising:

a. said means connecting said plates to said top chord lumber members consists of a plurality of transversely projecting prongs integrally formed in said plate members;

b. each of said pin openings in said plates is formed with a drawn sidewall forming a coaxial annular flange providing increased bearing area in contact with said pin, and said pin opening is positioned in an area of said plate disposed from said prongs;

c. a plurality of sleeve members having an opening therethrough for receiving said top chord pins and having an outside diameter substantially larger than the diameter of said pin;

d. the outside wall of each of said sleeves is positioned in registration with the openings in the upper ends of said web members and the pin openings in said plates;

e. a cutting tooth formed in leading relationship to each of said flanges on said arms for forming a channel in said bottom chord upon being driven into said bottom chord for force fitting occupancy by said flange; and f. said arms and said legs of said bottom chord connector are angularly related to the plane of said seat offsetting said bottom chord pin from the center line of said seat.

* * * * *